United States Patent [19]

Peckham

[11] Patent Number: 4,851,612

[45] Date of Patent: Jul. 25, 1989

[54] OUTLET PROTECTOR

[76] Inventor: Albert E. Peckham, 27 Bray St., West Gloucester, Mass. 01930

[21] Appl. No.: 93,558

[22] Filed: Sep. 8, 1987

[51] Int. Cl.[4] ..... H01R 13/44

[52] U.S. Cl. ..... 174/67; 439/136

[58] Field of Search ..... 174/67; 220/242; 439/135, 136

[56] References Cited

U.S. PATENT DOCUMENTS

| | | | |
|---|---|---|---|
| 2,462,756 | 2/1949 | Leopold | 174/67 X |
| 2,526,606 | 10/1950 | Gregg | 174/67 |
| 4,603,932 | 8/1986 | Heverly | 174/67 X |

*Primary Examiner*—Arthur T. Grimley
*Assistant Examiner*—David A. Tone
*Attorney, Agent, or Firm*—Donald N. Halgren

[57] ABSTRACT

A protective enclosure assembly for an electrical outlet having plug receptacles, having a baseplate which fits around the receptacles. The baseplate has a peripheral edge with notches arranged into two of the opposing edges. A transparent housing fits over the baseplate. The housing has a set of full tabs extending from one lower edge thereof, and a main locking and two small tabs extending from its opposite edge.

A set of slots are disposed through the housing wall, one slot between adjacent tabs on the multiple tab wall. The housing covers the receptacles when the housing walls are "pinched" so as to flex inwardly the walls, enabling the multiple tabs to mate with the notches on one edge of the baseplate, and enabling the one tab on the opposing wall of the housing to scamp into a notch on the opposing edge of the baseplate edge.

The baseplate then safely encloses any electrical cords plugged into the plug receptacles, the cords extending through the slots in one of the sidewalls of the housing. Any pulling on the cords causing the enclosure to lock more firmly into the notches because they are on the same sidewall of the housing.

3 Claims, 1 Drawing Sheet

48
36
51
42
50
44
49
46
60
56
54
38
40
58
52
10
31
26
18
28
28
30
31
20
12
29
32
16
22
14
24
30
29

36
52
58
54
60
51
38

24
20
18
26
14
29
30
31

OUTLET PROTECTOR

FIELD OF THE INVENTION

This invention relates to electrical outlets and more particularly to safety enclosures for those electrical outlets.

PRIOR ART

Electrical outlets can be dangerous temptations for small children. They are usually at a convenient height for them to reach, they are often located every eight to ten feet apart, and the cords which plug into them are easily graspable by the youngest child.

A number of attempts have been made to make the electrical outlets around the home, safer.

U.S. Pat. No. 4,603,932 to Heverly shows a frame which attaches to an outlet cover or base plate by a screw. A box-like enclosure locks to the frame by tabs at its lower side edge. A pair of slots on the lower end edge of the box permits passage of any electrical cords therepast. This device utilizes too many parts. The slots are in the wrong location which would permit the enclosure box to pivot off of the outlet if the cords it "protects" were pulled on.

U.S. Pat. No. 4,424,407 to Barbic discloses an outlet cover which rests upon a base, the cover being held to the face plate, by a bolt. Each cord is held in place by an arm attached to the screw. A pair of slots are disposed at the end of the cover. This is a somewhat more complicated cover. To change a cord, you need a screwdriver and a wrench.

U.S. Pat. No. 4,652,696 to Winnick shows a multiple hatched enclosure, openable only by two adult-sized hands. This would be somewhat cumbersome, and difficult to change cords, even for adults.

It is an object of the present invention to provide a very simple outlet enclosure which is child resistant.

It is a further object of the present invention to provide an outlet enclosure which permits easy determination of the plug status therewithin, with respect to the outlets.

It is a further object of the present invention to provide an outlet enclosure which is readily moved to a new outlet by an adult.

It is yet a further object of this invention to provide a removal resistant means which locks tighter to the base plate, when a cord is pulled upon at the outlet.

BRIEF SUMMARY OF THE INVENTION

The present invention relates to an outlet enclosure box which improves upon the prior art by permitting the user to see through it, to move it, and to be assured that it locks tightly when a child pulls on a cord which it covers.

The invention comprises an enclosure assembly protecting an electrical outlet. The enclosure assembly comprises a bezel baseplate which replaces the normal baseplate on an electrical outlet. The bezel baseplate has the normal rectangular periphery of a baseplate with a pair of openings through which the sockets of an outlet are disposed. The bezel baseplate however, has a peripheral lip which extends away from the flat surface of the plate. The bezel baseplate has a pair of long edges and a pair of short edges. Each long edge has three notches spaced evenly apart in the edgewall itself. The bezel baseplate has a central opening for screw attachment to an electrical outlet housing in a wall.

An enclosure housing is of rectangular configuration, having a lower edge which fits within the peripheral lip of the bezel baseplate. The enclosure housing has a pair of short end walls and a first and a second sidewall which are each longer than the end walls. An upper surface connects the side and endwalls. The sidewalls, end walls, and upper surface are all made from a transparent plastic material.

The first of the side walls has a main tab extending out sidewardly from the mid-point of its lower periphery. Equally spaced to each side of this main tab are two smaller tapered tabs having angled outer ends. The other or second side wall has three equal size hinge tabs extending out sidewardly at equally spaced apart locations on its lower periphery.

A pair of slots, one between the mid tab and each adjacent tab, are disposed through the second sidewall. The slots are arranged so as to permit an electrical cord to pass therethrough.

When one or more electrical cords are plugged into the electrical sockets within the bezel baseplate, the transparent enclosure housing may then be attached thereto. The first and second sidewalls may be slightly squeezed inwardly to slightly inwardly displace the main locking tab on the first sidewall. The three tabs on the opposing side of the enclosure housing may then be caused to mate with the three notches of its closest long edge of the bezel baseplate. The main single locking tab and small tapered tabs on the first side of the enclosure housing may then be permitted to "snap" into the notches on the other long edge of the bezel baseplate, the small tapered tabs being utilized for alignment purposes.

The electrical cords are of course extending through the slots on the second side of the enclosure housing, the side with the three full size tabs.

Since the housing is transparent, the relationship of the plugs on the ends of the cords, with the sockets, is readily determined.

Since the slots are on the side wall with the three full size tabs on it, and not the end walls or the side wall with the single large tab and small tapered tabs, when the cords are pulled or tugged upon, the three full size tabs lock into their notches and resist pulling free, thus enhancing the resistance of the enclosure to accidental opening.

The enclosure housing may be readily moved to any other electrical outlet, if that (those) outlet(s) have the bezel baseplates thereon, instead of a standard flat baseplate.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
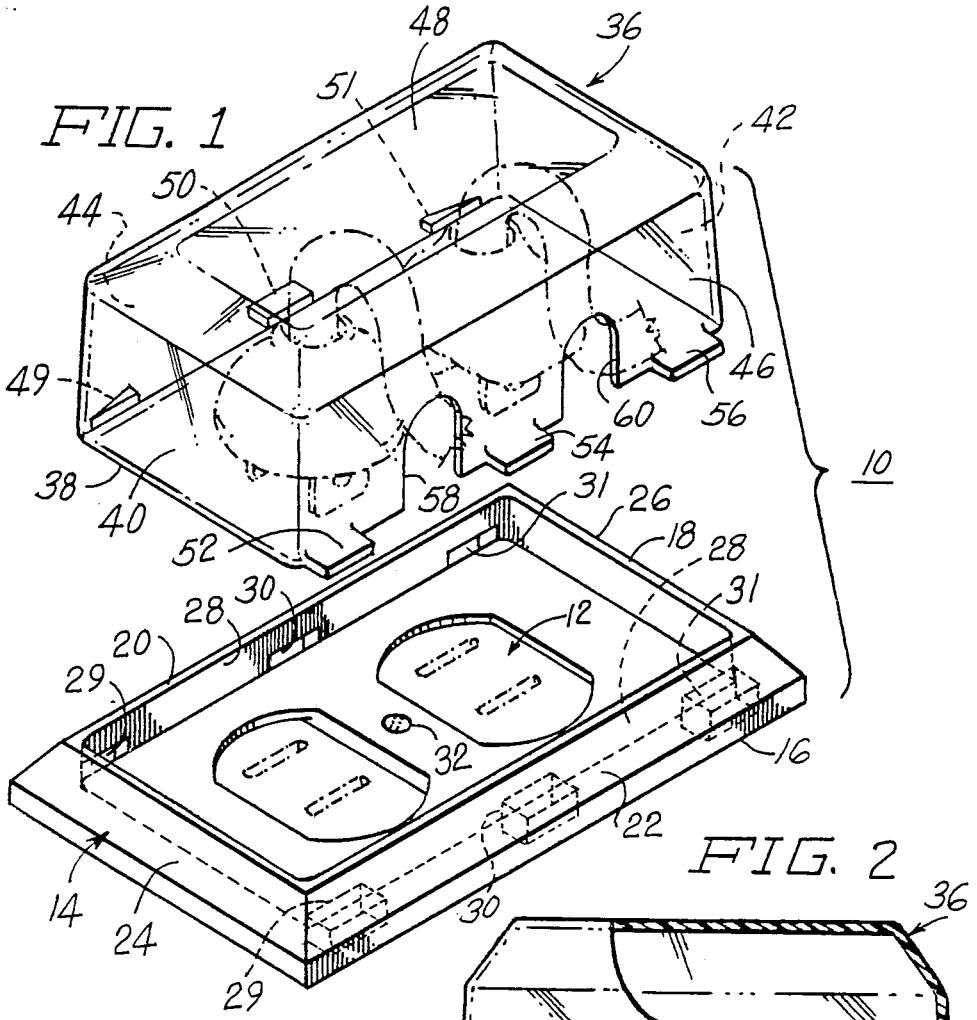
FIG. 1 is an exploded view, in perspective, of an electrical enclosure assembly constructed according to the principles of the present invention.

Referring now to the drawings, and to FIG. 1, in particular, there is shown an enclosure assembly 10 for protecting an electrical socket outlet 12. The enclosure assembly 10 comprises a bezel baseplate 14 having a rectangular periphery 16. A lip 18 extends about ⅛ to ½" away from the planar surface of the baseplate 14. The baseplate 14 has a pair of long sides 20 and 22 and a pair of short sides 24 and 26. Each long side 20 and 22 has an inner surface 28, into which an evenly spaced trio of notches 29, 30, and 31 are arranged. The bezel baseplate 14 has a hole 32 by which a screw secures the baseplate 14 to an electrical outlet 12 in a wall.

Figure 2:
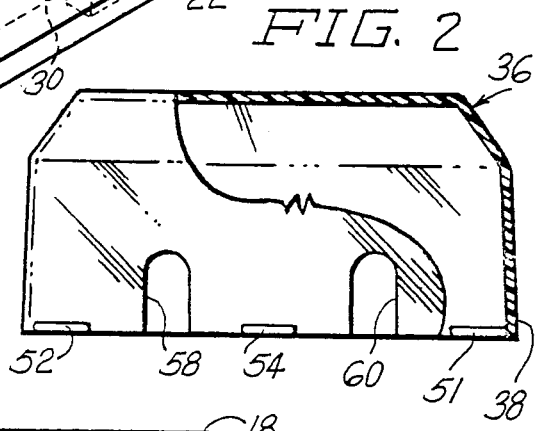
FIG. 2 is a side view of an enclosure housing.
Figure 3:
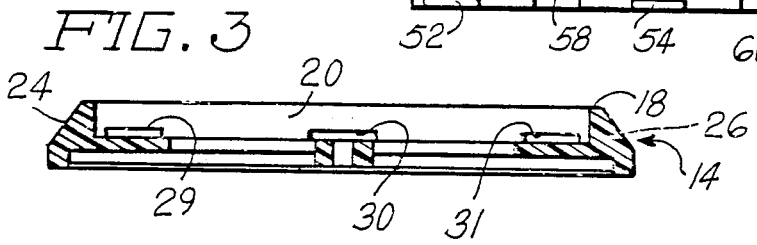
FIG. 3 is a sectional side view of a baseplate of the present invention.

An enclosure housing 36, shown in FIGS. 1 and 2, is of rectangular configuration, having a lower edge wall 38 which mates within the lip 18 of the baseplate 14. The enclosure housing 36 as a pair of short walls 40 and 42 and a first and a second sidewall 44 and 46, each of which are longer than the shortwalls 40 or 42. An upper surface 48 connects the walls 40, 42, 44, 46 and forms a cover of the enclosure assembly 10. The walls 40, 42, 44, and 46 as well as the upper surface 48 are made of a transparent plastic material so that the socket is visible.

The first sidewall 44 has a main full size tab 50 extending outwardly about 3/16" from the side thereof, at the mid-point of its lower periphery, and a pair of smaller tapered alignment tabs 49 and 51, which extend out no more than one-third as fas as the full size tabs, as may be seen in FIGS. 1 and 2. The second sidewall 46 has an array of three full size tabs 52, 54, and 56 extending out sidewardly at equally spaced apart locations on its lower periphery.

Slots 58 and 60, one spaced evenly between the mid full size tab 54 and each adjacent full size tab 52 and 56, are disposed through the second sidewall 46. It is critical to have the slots 58 and 60 on the side with the three full size tabs 52, 54, and 56, because they are the anchoring and pivot tabs. They provide the resistance to removal of the enclosure housing 36, by the pulling of any electrical cords.

Since there are three notches 29, 30 and 31 on each long side 20 and 22, of the bezel baseplate 14, the enclosure housing 36 may have its main full size locking tab 50 on its first sidewall 44 engage either middle notch 30. The small tabs 49 and 51 assist in preventing any twisting motion of the engaged enclosure. They are tapered so as to engage and disengage in unison with the center locking tab 50.

Once electrical plugs are plugged into the sockets 12, the three full size tabs 52, 54, and 56 on the second sidewall 46 are inserted into the three notches 29, 30, and 31 on one of the sides of the baseplate 14. The electrical cords having been extended through their respective slots 58 and 60 in that second sidewall 46, of course.

The first sidewall 44 on the enclosure housing 36 is pressed inwardly so as to slightly displace the main locking tab 50 thereon. The enclosure housing 36 may then be pivoted toward the sockets 12 and the main full size locking tab 50 engaged into the mid notch 30 on the unused side 20, or 22 of the bezel baseplate 14. Once the full size tabs 50, 52, 54, and 56 are engaged in their respective slots 29, 30, and 31, the sidewalls of the enclosure housing 36 will have to be pinched inwardly, and not pulled, to remove it from the bezel baseplate 14.

Thus there has been described a novel electrical outlet enclosure which includes a base which may be placed on all outlets in a house. The enclosure housings may then be used selectively in any particular area or room that a young child might be using. The housings are locked more tightly to their baseplates by pulling on the electrical cords, which they cover, because the pulling opposes normal "hinging" direction of the enclosure relative to the baseplate and the design of the enclosure locates the cord slots on the non-opening side between the full size "hinging"/anchoring tabs.

I claim:

1. A protective enclosure assembly for an electrical outlet having plug receptacles comprising:

a baseplate having a planar bottom surface with at least two plug engagement receptacle openings for securement to the electrical outlet, said baseplate including a pair of short sides and a pair of long sides with a lip disposed all along said sides, said lip having an arrangement of notches comprising receiving means along said edges;

an enclosure housing for pinched locked intermating thereof with said baseplate notch receiving means;

said enclosure housing comprising a transparent arrangement of walls and an upper cover thereon, at least one of said walls having a plurality of short releasable tabs and a lockable tab matable with said notch receiving means in said lip disposed around said baseplate on one edge of said enclosure housing and a plurality of main full size anchoring tabs disposed on the opposite edge of said enclosure housing engagable with notch receiving means in said lip; and a cord exit slot only between adjacent main full size anchoring tabs on said opposite edge of said enclosure housing to permit a cord to exit only through said anchoring side of said enclosure housing to prevent inadvertent removal of said enclosure housing from said baseplate.

2. A protective enclosure as recited in claim 1, wherein portions of said lip member are arranged on each of the long sides of said baseplate, each lip member portion having more than one notch arrangement disposed thereon.

3. A self-locking enclosure for an electrical outlet, comprising:

a baseplate having a pair of opposed long edges and a pair of opposed short edges, said baseplate having notch receiving means on said pair of opposed long edges;

a transparent enclosure housing having a pair of walls and an upper cover surface connecting said walls;

an arrangement of anchoring tabs disposed on the distal periphery of one of said walls;

a releasable locking tab disposed on the distal periphery of the other of said walls;

an arrangement of cord exit slots only between adjacent anchoring tabs for permitting an electrical cord to pass therethrough, preventing inadvertant disengagement thereof, from said baseplate; and a pair of alignment releasable tabs shorter than said locking tab between said releasable tabs, said pair of tabs each having a tapered outer edge to permit flexible displacement of its respective wall of said enclosure housing from its respective notch receiving means.

* * * * *